US009483007B2

(12) United States Patent
Shimodaira

(10) Patent No.: US 9,483,007 B2
(45) Date of Patent: Nov. 1, 2016

(54) IMAGE FORMING APPARATUS

(71) Applicant: FUJI XEROX CO., LTD., Tokyo (JP)

(72) Inventor: Akira Shimodaira, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/793,312

(22) Filed: Jul. 7, 2015

(65) Prior Publication Data

US 2016/0252865 A1 Sep. 1, 2016

(30) Foreign Application Priority Data

Feb. 27, 2015 (JP) ..... 2015-038947

(51) Int. Cl.
*G03G 15/00* (2006.01)

(52) U.S. Cl.
CPC ..... *G03G 15/6529* (2013.01)

(58) Field of Classification Search
CPC ..... G03G 15/6529
USPC ..... 399/400
See application file for complete search history.

(56) References Cited

U.S. PATENT DOCUMENTS 7,251,450 B2 * 7/2007 Murakami ..... G03G 15/6532 271/308
7,299,000 B2 * 11/2007 Taira ..... G03G 15/6573 399/322
8,971,731 B2 * 3/2015 Murakami ..... B65H 29/52 399/18
2010/0086334 A1 * 4/2010 Sakaya ..... G03G 15/2028 399/328
2011/0222920 A1 * 9/2011 Kobayashi ..... G03G 15/0194 399/299
2011/0255909 A1 * 10/2011 Tomura ..... G03G 15/0131 399/308

FOREIGN PATENT DOCUMENTS

JP 2004115266 A 4/2004
JP 2008299147 A 12/2008

* cited by examiner

*Primary Examiner* — Anthony Nguyen
(74) *Attorney, Agent, or Firm* — Oliff PLC

(57) ABSTRACT

An image forming apparatus includes a transfer device, a fixing device, an introduction guide member that introduces the leading edge of a recording medium to the fixing device, and a contact guide member that causes the leading edge of the recording medium to contact the introduction guide member. The contact guide member has a first guide part and a second guide part. The first guide part causes the leading edge of a first recording medium, which includes a recording medium of a double-sheet structure, to contact the introduction guide member at a first contact angle. The second guide part causes the leading edge of a second recording medium, which has a feed width greater than the passage width of the first guide part, to contact the introduction guide member at a second contact angle. The first contact angle is greater than the second contact angle.

7 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2015-038947 filed Feb. 27, 2015.

BACKGROUND

Technical Field

The present invention relates to an image forming apparatus.

SUMMARY

According to an aspect of the invention, there is provided an image forming apparatus including a transfer device that has a toner image carrier and a transfer body that rotate, and a transfer part where the toner image carrier and the transfer body contact each other, the transfer device allowing a recording medium to pass through the transfer part to transfer a toner image to the recording medium, a fixing device that has a heat body and a pressure body that rotate, and a fixing part where the heat body and the pressure body contact each other, the fixing device allowing the recording medium with the toner image transferred by the transfer device to pass through the fixing part to fix the toner image to the recording medium, an introduction guide member that has a guiding portion, the introduction guiding member being disposed at an entrance side of the fixing device, the introduction guide member guiding a leading edge of the recording medium so that the leading edge of the recording medium approaches the heat body before being introduced to the fixing part, and a contact guide member that is disposed between the transfer device and the introduction guide member, the contact guide member guiding the leading edge of the recording medium into contact with the guiding portion of the introduction guide member. The contact guide member has a first guide part that guides a leading edge of a first recording medium into contact with the introduction guide member at a first contact angle, the first recording medium including a recording medium of a double-sheet structure, and a second guide part that guides a leading edge of a second recording medium into contact with the introduction guide member at a second contact angle, the second recording medium having a feed width greater than a passage width of the first guide part. The first contact angle is an angle formed by a back side of the leading edge of the first recording medium with the guiding portion of the introduction guide member, and the second contact angle is an angle formed by a back side of the leading edge of the second recording medium with the guiding portion of the introduction guide member. The first guide part and the second guide part are configured so that the first contact angle is greater than the second contact angle.

BRIEF DESCRIPTION OF THE DRAWINGS

Exemplary embodiments of the present invention will be described in detail based on the following figures, wherein.

DETAILED DESCRIPTION

Hereinafter, exemplary modes for carrying out the present invention (to be simply referred to as "exemplary embodiments" hereinafter) will be described with reference to the attached figures.

EXEMPLARY EMBODIMENT 1

Figure 1:
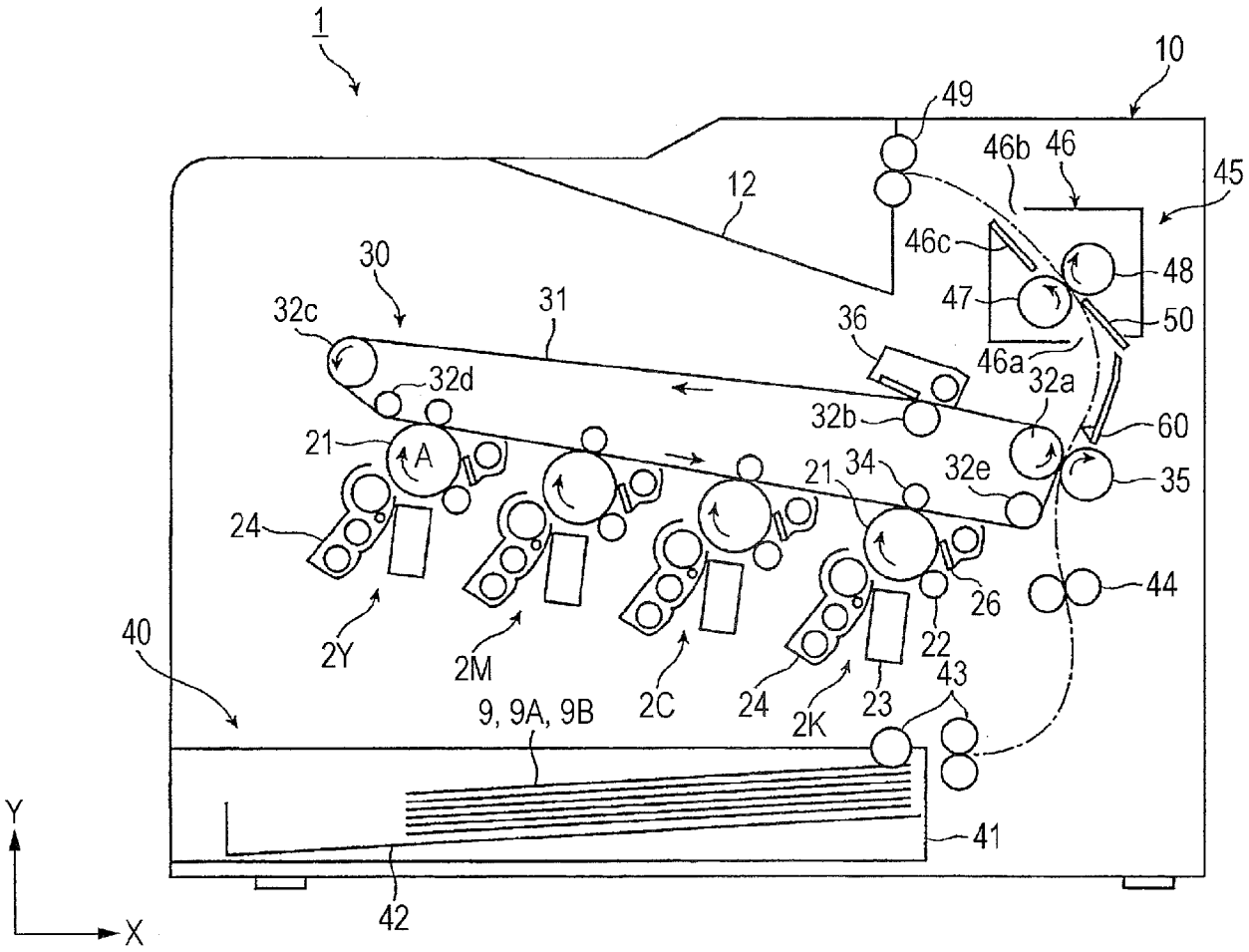
FIG. 1 conceptually illustrates a general configuration of an image forming apparatus according to Exemplary Embodiment 1.
Figure 2:
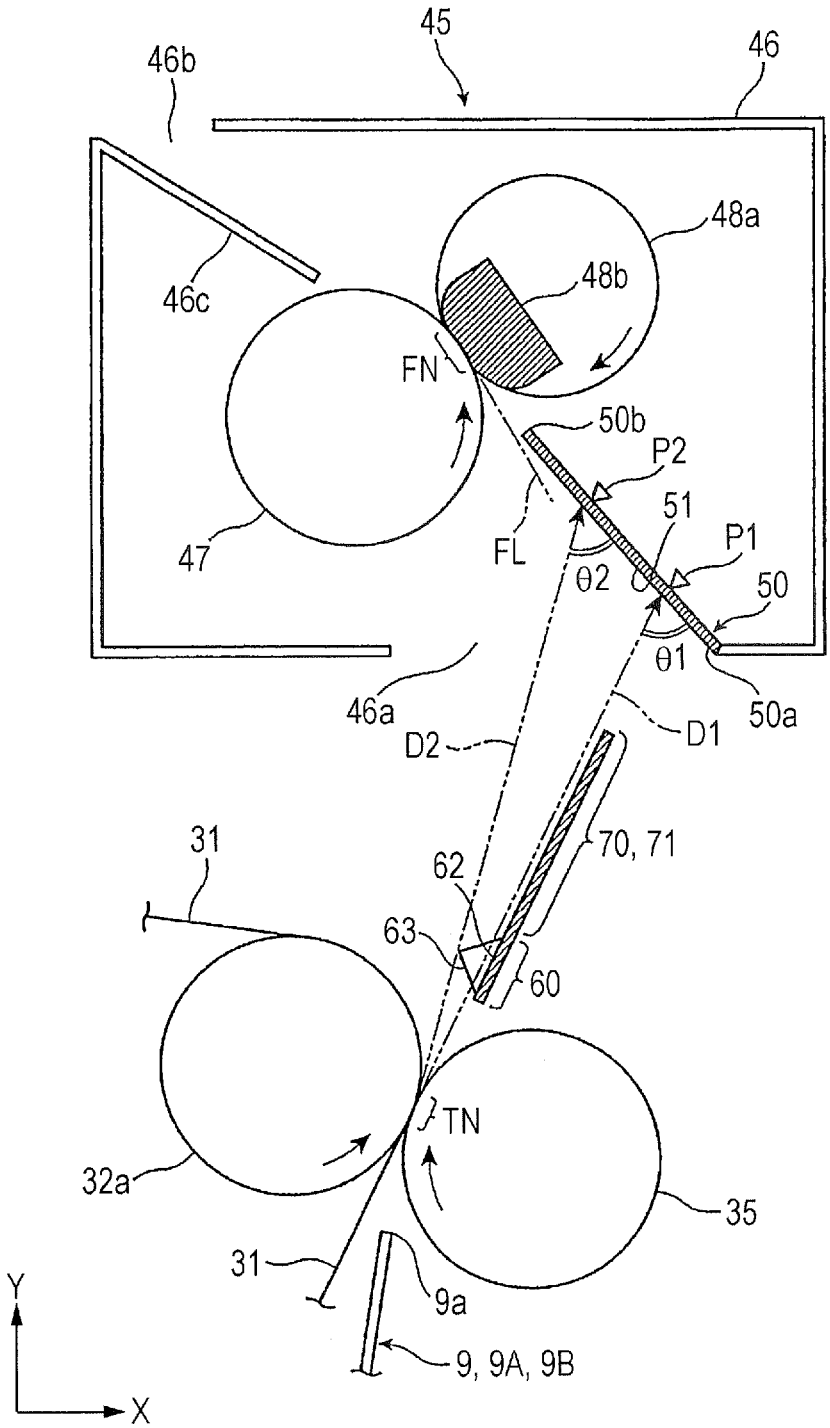
FIG. 2 is an enlarged schematic view, partly in section, of a major part (a transport part for a recording medium between a transfer part and a fixing part) of the image forming apparatus illustrated in FIG. 1.

FIGS. 1 and 2 illustrate an image forming apparatus according to Exemplary Embodiment 1. FIG. 1 conceptually illustrates a general configuration of the image forming apparatus, and FIG. 2 conceptually illustrates a major part (a transport part for a recording medium between a transfer part and a fixing part) of the image forming apparatus. Arrows indicated by symbols X, Y, and Z in the drawings including FIG. 1 denote (the directions of) orthogonal coordinate axes representing the directions of width, height, and depth, respectively, of a three-dimensional space assumed in the drawings.

<General Configuration of Image Forming Apparatus>

An image forming apparatus 1 forms an image made from developer on a recording medium 9 such as recording paper. For example, the image forming apparatus 1 is configured as a printer that forms an image in response to an input of image information from external equipment such as an information terminal.

The image forming apparatus 1 has a housing 10 having a generally box-like outward appearance. As illustrated in FIG. 1, components such as an image forming unit 2, an intermediate transfer device 30, a paper feeder 40, and a fixing device 45 are disposed inside the housing 10. The image forming unit 2 forms a toner image made from toner as developer. The intermediate transfer device 30 relays and transports the toner image formed by the image forming unit 2, and finally transfers the toner image to the recording medium 9 for second transfer. The paper feeder 40 receives and feeds the recording medium 9 that is to be supplied to a second transfer position of the intermediate transfer device 30. The fixing device 45 fixes the toner image transferred by second transfer by the intermediate transfer device 30, onto the recording medium 9. The top portion of the housing 10 is provided with an output receiving part 12 for outputting the recording medium 9 on which an image has formed, and receiving the recording medium 9 in a stacked state. An alternate long and short dash line illustrated in FIG. 1 indicates a representative transport path of the recording medium 9 within the housing 10.

The image forming unit 2 includes four image forming units 2Y, 2M, 2C, and 2K that individually form developer (toner) images of four colors, yellow (Y), magenta (M), cyan (C), and black (K), respectively. The image forming units 2 (Y, M, C, and K) are disposed inside the housing 10 in such a way (in an inclined state) so as to become gradually higher in level in order of black, cyan, magenta and yellow.

Each of the four image forming units 2 (Y, M, C, and K) includes components such as a photoconductor drum 21, a charging device 22, an exposure device 23, a developing device 24 (Y, M, C, or K), and a drum cleaner 26. The photoconductor drum 21 is a photoconductor in the form of a drum which is rotationally driven in the direction indicated by an arrow A. The charging device 22 charges the peripheral surface of the photoconductor drum 21, which is a region of the photoconductor drum 21 on which to form an image, to a required potential. The exposure device 23 irradiates the charged peripheral surface of the photoconductor drum 21 with light decomposed into each individual color component based on required image information, thereby forming an electrostatic latent image of each individual color component. The developing device 24 (Y, M, C, or K) develops the electrostatic latent image with a toner of the corresponding color component to render a visible toner image for each of the color components (Y, M, C, and K) mentioned above. The drum cleaner 26 cleans the photoconductor drum 21 by removing unnecessary substances such as toner that remain on the peripheral surface of the photoconductor drum 21 after the toner image on the photoconductor drum 21 is transferred by first transfer to (an intermediate transfer belt 31 of) the intermediate transfer device 30.

In each of the image forming units 2 (Y, M, C, and K), upon receiving a request for forming an image, the peripheral surface of the photoconductor drum 21 that starts to rotate is charged to a required potential by the charging device 22. Then, the charged peripheral surface of the photoconductor drum 21 is irradiated with light corresponding to an image signal of each individual color component from the exposure device 23, thereby forming an electrostatic latent image of each individual color component.

Subsequently, the electrostatic latent image of each individual color component formed on the peripheral surface of the corresponding photoconductor drum 21 is developed with a toner of one of the above-mentioned four colors (Y, M, C, and K) in the corresponding developing device 24 (Y, M, C, or K), thus forming a toner image of each of the four colors on the corresponding photoconductor drum 21.

The intermediate transfer device 30 is disposed vertically above the four image forming units 2 (Y, M, C, and K), in a slightly inclined state corresponding to the inclined disposition of the image forming units 2 (Y, M, C, and K).

The intermediate transfer device 30 includes components such as the intermediate transfer belt 31, multiple support rollers 32*a* to 32*e*, a first transfer device 34, a second transfer device 35, and a belt cleaner 36. The intermediate transfer belt 31 is an endless belt to which a toner image formed on the photoconductor drum 21 of each of the image forming units 2 (Y, M, C, and K) can be transferred by an electrostatic action so as to be carried by the intermediate transfer belt 31. The support rollers 32*a* to 32*e* support the intermediate transfer belt 31 in such a way that as the intermediate transfer belt 31 rotates, the intermediate transfer belt 31 sequentially passes through the respective first transfer positions of the image forming units 2 (Y, M, C, and K). The first transfer device 34, which is in the form of a roller or the like, transfers a toner image formed on the photoconductor drum 21 of each of the image forming units 2 (Y, M, C, and K) to the peripheral surface of the photoconductor drum 21 for first transfer. The second transfer device 35, which is in the form of a roller or the like, transfers the toner image transferred by first transfer to the intermediate transfer belt 31, to the recording medium 9 for second transfer. The belt cleaner 36 cleans the intermediate transfer belt 31 by removing unnecessary substances such as toner that remain on the peripheral surface of the intermediate transfer belt 31 after the second transfer.

Among these, the support roller 32*a* doubles as a driving roller and a second transfer backup roller, the support roller 32*c* is a tension applying roller, the support rollers 32*d* and 32*e* are surface shaping rollers, and the support roller 32*b* is a cleaning backup roller.

The paper feeder 40 is disposed vertically below the four image forming units 2 (Y, M, C, and K).

The paper feeder 40 includes a paper receiver 41 and a sending device 43. The paper receiver 41, which is attached to the housing 10 in a manner that allows the paper receiver 41 to be freely drawn out, receives the recording medium 9 of a desired size, type, or the like in a state in which sheets of the recording medium 9 are stacked on a stacking plate 42. The sending device 43 sends out the recording medium 9 from the paper receiver 41 sheet by sheet. In the paper feeder 40, at the time of forming an image, the recording medium 9 is sent out by the sending device 43 sheet by sheet as required from the paper receiver 41. The recording medium 9 sent out from the paper feeder 40 travels along the transport path indicated by the alternate long and short dash line. Then, the recording medium 9 is finally sent to a second transfer position located opposite the second transfer device 35 of the intermediate transfer device 30, in synchronism with the timing of second transfer by a pair of transport timing control rollers 44 disposed in the transport path.

In the intermediate transfer device 30, at the time of forming an image, toner images of various colors formed on the respective photoconductor drums 21 of the image forming units 2 (Y, M, C, and K) are sequentially transferred for first transfer to the peripheral surface of the intermediate transfer belt 31 by the first transfer device 34 in a state in which the toner images are aligned with the peripheral surface of the intermediate transfer belt 31. At this time, in each of the image forming units 2 (Y, M, C, and K), the peripheral surface of the photoconductor drum 21 after the first transfer is cleaned by the drum cleaner 26.

Subsequently, the intermediate transfer belt 31 transfers the toner image transferred by first transfer, to the second transfer position. Thereafter, the intermediate transfer device 30 transfers the toner image on the intermediate transfer belt 31 for second transfer to the recording medium 9 that has been supplied to the second transfer position from the paper feeder 40. At this time, in the intermediate transfer device 30, the peripheral surface of the intermediate transfer belt 31 after the second transfer is cleaned by the belt cleaner 36.

The fixing device 45 is disposed vertically above the second transfer part (portion where the second transfer device 35 is in contact with the intermediate transfer belt 31) of the intermediate transfer device 30.

The fixing device 45 includes components such as a heat rotator 47 and a pressure rotator 48 that are installed inside a housing 46 of the fixing device 45. The heat rotator 47, which is in the form of, for example, a roller or a belt, is rotationally driven in a required direction, and heated by a heating unit so that its surface is kept at a required temperature. The pressure rotator 48, which is in the form of, for example, a roller or a belt, rotates following the rotation of the heat rotator 47 by coming into contact with the heat rotator 47 with a required pressure substantially along the direction of the rotational axis of the heat rotator 47.

As the heat rotator 47, a heat roller in the form of a roller is used. The pressure rotator 48 includes a fixing belt 48*a* and a pressing body 48*b* (FIG. 2). The fixing belt 48*a*, which has an annular shape, is able to rotate while in contact with the heat rotator 47. The pressing body 48*b* presses the fixing belt 48*a* against the heat rotator 47, forming a nip part (fixing part) FN. The housing 46 has an entrance (opening) 46*a* through which the recording medium 9 on which to fix an image is introduced, and an exit (opening) 46*b* through which the recording medium 9 on which an image has been fixed is discharged. Further, a discharge guide member 46*c* is disposed at the exit 46*b* of the housing 46. The discharge guide member 46*c* guides discharge of the recording medium 9 on which an image has been fixed.

The fixing device 45 adopts a belt nip system in which the pressure rotator 48 is made up of components such as the fixing belt 48*a* and the pressing body 48*b*. This makes it possible to ensure a relatively long passage length (the length along the rotational direction of the heat rotator 47) of the nip part FN formed between the pressure rotator 48 and the heat rotator 47. Further, the fixing device 45 is configured so that in the nip part (fixing part) FN where the heat rotator 47 and the pressure rotator 48 contact each other, the surface of the pressure rotator 48 (the fixing belt 48*a* pressed against the heat rotator 47 by the pressing body 48*b*) undergoes a greater amount of elastic deformation than the surface of the heat rotator 47 (the surface of the roller).

In the fixing device 45, at the time of forming an image, the recording medium 9 with a toner image transferred by second transfer by the intermediate transfer device 30 passes through the entrance 46*a* of the housing 46, and is sent to the nip part FN formed between the heat rotator 47, which is the rotating heat rotator, and the fixing belt 48*a* and the pressing body 48*b* of the pressure rotator. Then, the fixing device 45 applies heat and pressure as the recording medium 9 passes through the nip part FN, thus fusing and fixing the toner image onto the recording medium 9.

After the recording medium 9 with the fixed image is discharged through the exit 46*b* of the housing 46, the recording medium 9 travels along the transport path indicated by the alternate long and short dash line. The recording medium 9 is transported to the outside of the housing 10 by a pair of output rollers 49 disposed in a terminal end portion of the transport path, before being finally received by the output receiving part 12.

The image forming apparatus 1 is able to form a color image made from a combination of all or some (at least two or more) of the four colors (Y, M, C, and K) of toners, by selectively activating all or some (two or more) of the image forming units 2 (Y, M, C, and K). Further, the image forming apparatus 1 is also able to form a monochrome image made from a single color of toner such as black, by activating one of the image forming units 2 (Y, M, C, and K).

Further, the image forming apparatus 1 adopts a so-called center registration system for the recording medium 9. The center registration system refers to a transport control system that controls transport of the recording medium 9 so that until the recording medium 9 from the paper feeder 40 is discharged from the fixing device 45 via the second transfer part, the portion of the recording medium 9 located at the center of its feed width passes through the center position of the feed width of the transport path (transport space) of the recording medium 9.

<Configuration of Transport Part Between Transfer Part and Fixing Part>

As illustrated in FIGS. 1, 2, and the like, the image forming apparatus 1 includes an introduction guide member 50 and a contact guide member 60 between the second transfer device 35 of the intermediate transfer device 30 and the fixing device 45. The introduction guide member 50, which is disposed at the entrance 46*a* side of the fixing device 45, guides a leading edge 9*a* of the recording medium 9 so that the leading edge 9*a* of the recording medium 9 approaches the heat rotator 47 before being introduced to the nip part FN of the fixing device 45. The contact guide member 60, which is disposed between the second transfer device 35 and the introduction guide member 50, guides the leading edge 9*a* of the recording medium 9 into contact with a guiding portion 51 of the introduction guide member 50.

In the introduction guide member 50, the entirety of the guiding portion 51 that guides the recording medium 9 extends continuously in an inclined manner so as to gradually approach the entrance-side normal FL (FIG. 2) to the nip part FN with increasing proximity to the nip part FN of the fixing device 45. The introduction guide member 50 according to Exemplary Embodiment 1 is configured by a plate-like member, of which the guiding portion 51 that guides the recording medium 9 is configured by a planar surface. Further, the introduction guide member 50 is secured to the edge portion of the entrance 46*a* of the housing 46 of the fixing device 45.

The contact guide member 60 has a first guide part 62 and a second guide part 63. The first guide part 62 guides the leading edge 9*a* of a first recording medium 9A, which has a feed width less than the dimension of the short side of A4-size paper, into contact with the introduction guide member 50 at a first contact angle θ1. The second guide part 63 guides the leading edge 9*a* of a second recording medium 9B, which has a feed width greater than or equal to the dimension of the short side of A4-size paper, into contact with the introduction guide member 50 at a second contact angle θ2. The first guide part 62 and second guide part 63 of the contact guide member 60 are configured so that the first contact angle θ1 is greater than the second contact angle θ2 (the following magnitude relation holds: $\theta1>\theta2$).

In this regard, the first contact angle θ1 and the second contact angle θ2 are to be regarded as designed values only. This means that the leading edge 9*a* of the first recording medium 9A and the leading edge 9*a* of the second recording medium 9B do not necessarily come into contact with the guiding portion 51 of the introduction guide member 50 at the same contact angles θ1 and θ2, respectively, at all times. However, the contact angles θ1 and θ2 are designed so as to satisfy the above magnitude relation ($\theta1>\theta2$) when the leading edges 9*a* of the two recording media 9A and 9B actually come into contact with the guiding portion 51. The first contact angle θ1 and the second contact angle θ2 are angles formed by the back sides of the leading edges 9*a* of the first recording medium 9A and second recording medium 9B, respectively, with the guiding portion 51 of the introduction guide member 50. Further, of the front and back sides of the recording medium 9, the back side refers to the side opposite to the side to which a toner image is transferred immediately before the toner image is fixed by the fixing device 45 (or the side that comes into contact with the pressure rotator 48 at the time of fixing a toner image to the recording medium 9 in the fixing device 45).

The A4 size mentioned above is a paper size standard defined by the Japanese Industrial Standards (JIS). As for the dimensions of its long and short sides, the A4 size is defined as measuring "297 mm on the long side by 210 mm on the short side". While the first recording medium 9A is not particularly limited as long as the first recording medium 9A has a feed width (the dimension of the portion of the first recording medium 9A corresponding to the width when transported) less than the dimension of the short side of A4-size paper, effects described later are obtained if the first recording medium 9A is of a double-sheet structure (a structure in which two sheets of paper are formed into a bag-like shape). The second recording medium 9B is not particularly limited as long as its feed width is greater than or equal to the dimension of the short size of A4-size paper. Examples of the second recording medium 9B include recording media such as plain paper and coated paper.

The contact guide member 60 can be described in other words as follows.

That is, the contact guide member 60 is a member having the first guide part 62 that guides the leading edge 9*a* of the first recording medium 9A into contact with the introduction guide member 50 at a first position P1, and the second guide part 63 that guides the leading edge 9*a* of the second recording medium 9B into contact with the introduction guide member 50 at a second position P2. At this time, the first guide part 62 and second guide part 63 of the contact guide member 60 are configured so that the first position P1 is located farther from the nip part FN than the second position P2 (so that the following distance relation holds: the distance of the first position P1 from the nip part FN>the distance of the second position P2 from the nip part FN).

In this case as well, the first position P1 and the second position P2 are to be regarded as designed contact positions only. This means that the leading edge of the first recording medium 9A and the leading edge of the second recording medium 9B do not necessarily come into contact with the guiding portion 51 of the introduction guide member 50 at the same positions P1 and P2, respectively, at all times. However, the positions P1 and P2 are designed so as to satisfy the above distance relation when the leading edges of the two recording media 9A and 9B actually come into contact with the guiding portion 51.

In Exemplary Embodiment 1, an auxiliary guide member 70 is further disposed between the introduction guide member 50 and the contact guide member 60. The auxiliary guide member 70 aids in guiding of at least the first recording medium 9A.

Figure 4:
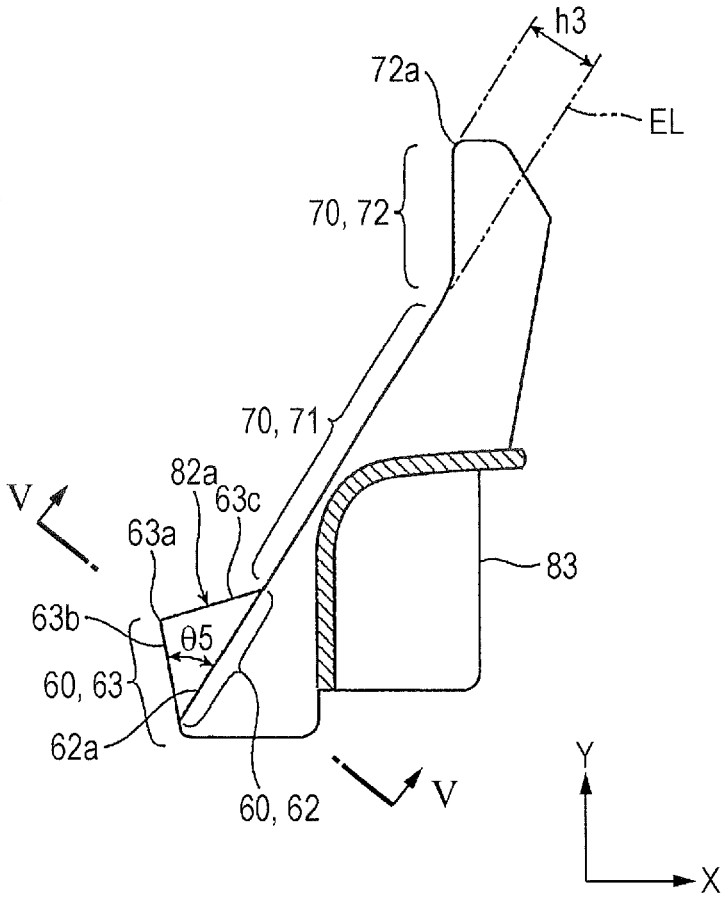
FIG. 4 is a front view, as seen from the front side, of specific first and second guide plates of the structure of the contact guide member illustrated in FIG. 3.

As illustrated in FIGS. 2, 4, and the like, the auxiliary guide member 70 has at least an extended guide portion 71, which is a linear extension of the first guide part 62 of the contact guide member 60. Incidentally, in the auxiliary guide member 70, the extended guide portion 71 as an extension of the first guide part 62 is also disposed between the second guide part 63 of the contact guide member 60 and the introduction guide member 50 (see FIG. 4 and the like). Further, the auxiliary guide member 70 is also provided with a final guide portion 72. The final guide portion 72 is located in a terminal end portion of the extended guide portion 71 which is located on the downstream side in the transport direction of the recording medium 9.

Figure 5:
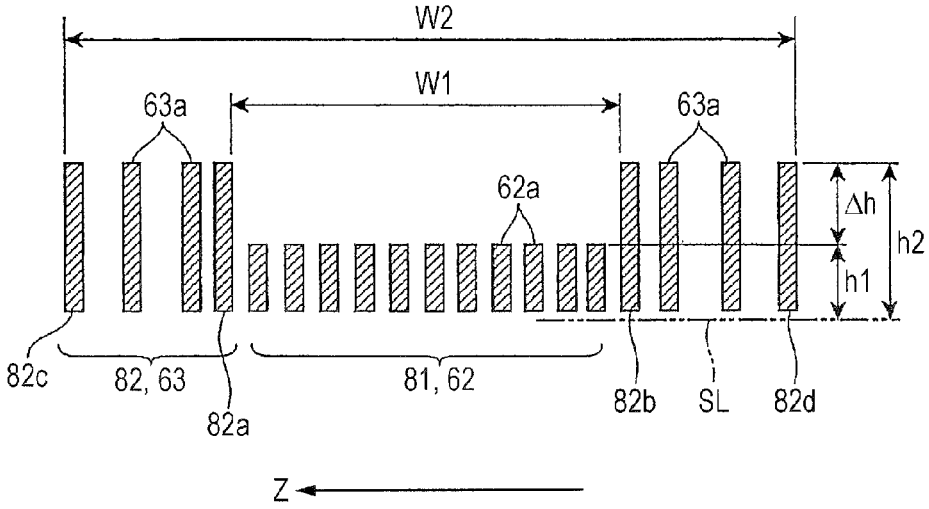
FIG. 5 is a schematic sectional view taken along a line V-V of the contact guide member illustrated in FIG. 3 or 4.
Figure 6:
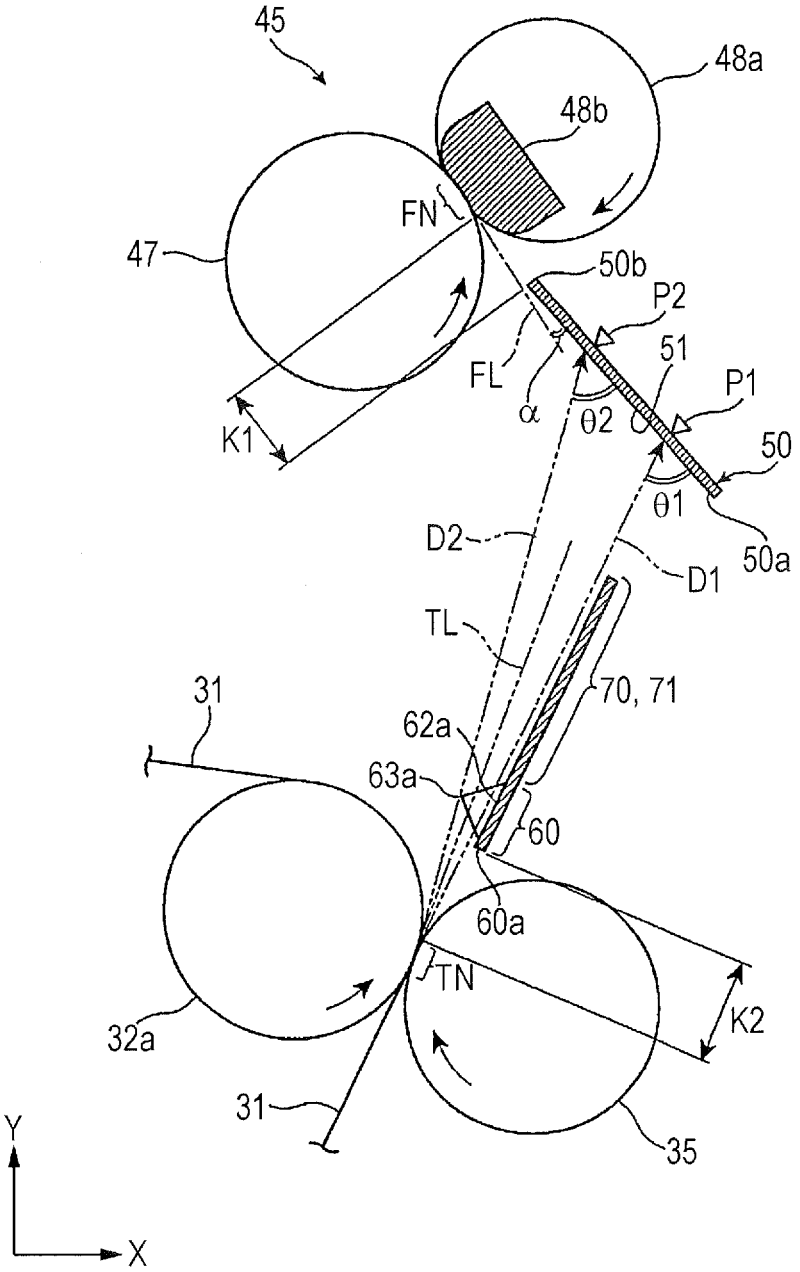
FIG. 6 illustrates detailed configuration of an introduction guide member, a contact guide member, and the like according to Exemplary Embodiment 1.

As illustrated in FIGS. 4 to 6 and the like, the contact guide member 60 according to Exemplary Embodiment 1 is integrated with the auxiliary guide member 70.

That is, the contact guide member 60 includes multiple (for example, twelve) first guide plates 81, multiple (for example, eight) second guide plates 82, and a connecting member 83. The first guide plates 81 are formed in such a shape that the first guide part 62 of the contact guide member 60 and the auxiliary guide member 70 are integrated together. The second guide plates 82 are formed in such a shape that the second guide part 63 of the contact guide member 60 and the auxiliary guide member 70 are integrated together. The connecting member 83 connects and integrates the first guide plates 81 and the second guide plates 82 together.

Figure 3:
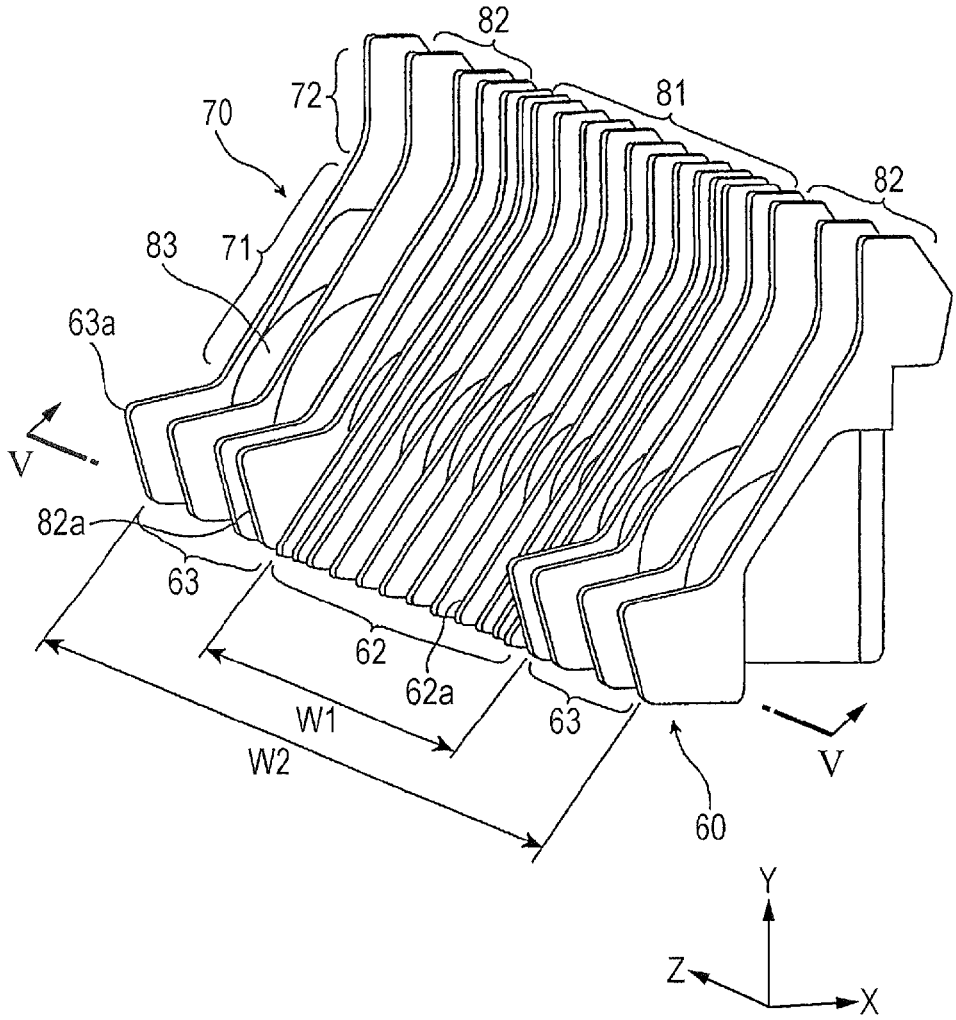
FIG. 3 is a perspective view illustrating a structure of a contact guide member (including an auxiliary guide member) according to Exemplary Embodiment 1.

In the contact guide member 60 (and the auxiliary guide member 70), as illustrated in FIGS. 3 and 5, the first guide plates 81 and the second guide plates 82 are disposed as described below. That is, the first guide plates 81 are disposed at predetermined intervals in a parallel fashion in the central part in the direction of the feed width (the direction substantially orthogonal to the transport direction, or the direction substantially along the coordinate axis Z) of the recording medium 9. The second guide plates 82, which are placed in a distributed fashion on both end sides of the first guide plates 81 in the direction of the feed width of the recording medium 9, are disposed at predetermined intervals in a parallel fashion.

The contact guide member 60 is secured to a support frame or the like (not illustrated) constituting the housing 10 of the image forming apparatus 1. Further, the contact guide member 60 is disposed in close proximity to a nip part (transfer part) TN of the second transfer part so that the leading edges 9*a* of various types of the recording media 9 can pass through the contact guide member 60 upon exiting the nip part TN.

More specifically, in the first guide plate 81, the first guide part 62 of the contact guide member 60 and the extended guide portion 71 of the auxiliary guide member 70 are formed as a linear guide part (edge) in which the first guide part 62 and the extended guide portion 71 are linearly contiguous with each other, and the final guide portion 72 of the auxiliary guide member 70 is formed as an elevated guide part (edge) that is inclined so as to be elevated progressively with respect to an imaginary extended line EL, which is an extension of a projected guide line of the linear guide part (FIG. 4).

In the second guide plate 82, the second guide part 63 of the contact guide member 60 is formed as a raised guide part (edge) that is defined by two oblique sides of a triangle whose base is the linear guide part of the first guide part 62 and which is so shaped as to rise from the linear guide part. Further, in the second guide plate 82, the extended guide portion 71 of the auxiliary guide member 70 is formed as a linear guide part (edge) equivalent to the linear guide part of the first guide part 62. Furthermore, in the second guide plate 82, the final guide portion 72 of the auxiliary guide member 70 is formed as an elevated guide part (edge) equivalent to the elevated guide part of the first guide plate 81. Incidentally, the second guide part 63 formed as a raised guide part has two oblique sides 63*b* and 63*c* that cross at an apex 63*a* (FIG. 4). Among these, the portions of the second guide part 63 which actually guide the recording medium 9 are the oblique side (to be also referred to as "guiding portion" hereinafter) 63*b* located on the upstream side in the transport direction of the recording medium 9, and the apex (to be also referred to as "guiding portion" hereinafter) 63*a*.

In order to provide a transport space for allowing the first recording medium 9A, which has a feed width less than the dimension of the short side of A4-size paper, to be guided to and passed through the first guide part 62 of the contact guide member 60, the first guide plates 81 are disposed so as to secure a first passage width W1 substantially corresponding to the above feed width. As illustrated in FIG. 5 and the like, in actuality, the first passage width W1 at this time is determined by the separation distance between the side surfaces of two guide plates 82*a* and 82*b* disposed immediately outside the opposite end portions of the first guide plates 81. The first passage width W1 that defines the first guide part 62 is set to a width less than the dimension of the short side of A4-size paper. Since the center registration system is adopted as the transport control system for the recording medium 9 as mentioned above, the first passage width W1 is located in the central part in the direction of the feed width of the recording medium 9.

In order to provide a transport space for allowing the second recording medium 9B, which has the maximum feed width of the feed widths greater than or equal to the dimension of the short side of A4-size paper, to be guided to and passed through the second guide part 63 of the contact guide member 60, the second guide plates 82 are disposed so as to secure a second passage width W2 (>W1) substantially corresponding to the maximum feed width. The second passage width W2 at this time substantially corresponds to the separation distance between second guide plates 82*c* and 82*d* that are the two most outwardly located guide plates of the second guide plates 82 disposed in a distributed fashion on both end sides of the first guide plates 81. As the second passage width W2, for example, the dimension of the long side of A4-size paper is adopted.

Further, as illustrated in FIGS. 2, 5, and the like, in the contact guide member 60 according to Exemplary Embodiment 1, a guiding portion 62*a*, which is a portion of the first guide part 62 through which the first recording medium 9A is passed to determine a transport direction D1, is located lower than the guiding portion 63*a*, which is a portion of the second guide part 63 through which the second recording medium 9B is passed to determine a transport direction D2.

In this regard, the guiding portion 62*a* of the first guide part 62 is configured as a linear guide part that extends linearly as described above. As described above, the guiding portion 63*a* of the second guide part 63 is configured as the apex of the raised guide part formed by the two oblique sides 63*b* and 63*c* of a triangle. Symbol h1 illustrated in FIG. 5 denotes the height of the guiding portion 62*a* of the first guide part 62 from an imaginary reference line SL running substantially along the direction of the feed width of the recording medium 9 (the direction of the coordinate axis Z). Symbol h2 illustrated in FIG. 5 denotes the height of the guiding portion 63*a* of the second guide part 63 from the imaginary reference line SL. The respective heights h1 and h2 of the guiding portions 62*a* and 63*a* have the following magnitude relation: h1<h2.

The height h1 of the guiding portion 62*a* in the first guide part 62 is set in accordance with the transport direction D1 of the first recording medium 9A. Likewise, the height h2 of the guiding portion 63*a* (apex) of the second guide part 63 is set in accordance with the transport direction D2 of the second recording medium 9B. Each of the transport directions D1 and D2 at this time is set from the viewpoint of realizing the contact angle θ1 or θ2, or the contact position P1 or P2 when the leading edge 9*a* of the first recording medium 9A or the second recording medium 9B comes into contact with the guiding portion 51 of the introduction guide member 50.

Incidentally, the height h1 of the guiding portion 62*a* of the first guide part, and the height h2 of the guiding portion 63*a* of the second guide part are set so that their difference Δh (=h2−h1) is, for example, approximately 5 mm to 15 mm. Further, in the final guide portion 72 formed by the elevated guide part (edge) of the auxiliary guide member 70, the height (elevation difference) h3 of its terminal end portion (uppermost portion) 72*a* from the imaginary extended line EL is set to less than or equal to, for example, 20 mm (FIG. 4).

In Exemplary Embodiment 1, for example, the following conditions apply to the introduction guide member 50, the contact guide member 60, and the auxiliary guide member 70.

That is, as illustrated in FIG. 6, a flat plate made of metal is used as the introduction guide member 50. In the introduction guide member 50 formed by a flat plate, a terminal end portion (end portion near the nip part FN of the fixing device 45) 50*b* of the guiding portion 51 having a planar shape is disposed at a separation distance K1 of approximately 2 mm to 5 mm from the entrance-side end portion of the nip part FN, in such a way that the terminal end portion 50*b* is located in close proximity to the entrance-side normal to the nip part FN. Furthermore, the introduction guide member 50 is disposed in such a way that the guiding portion 51 forms an angle (inclination angle) a of approximately three to five degrees with the entrance-side normal FL. In the introduction guide member 50, the width of the guiding portion 51 in the direction substantially orthogonal to the transport direction of the recording medium 9 is greater than or equal to the maximum feed width (W2) of the recording medium 9, and the length of the guiding portion 51 along the transport direction of the recording medium 9 (the dimension from a guide beginning end portion 50*a* to the terminal end portion 50*b*) is approximately 250 mm to 300 mm.

As illustrated in FIGS. 6, 3, and the like, as the contact guide member 60, the exemplary embodiment adopts a member (made up of the first and second guide plates 81 and 82) having the first guide part 62 that is linearly shaped and provided with the guiding portion 62*a*, and the second guide part 63 that is raised in the shape of a triangle and provided with the guiding portion 63*a*. The respective heights h1 and h2 of the guiding portions 62*a* and 63*a* the first guide part 62 and second guide part 63 are set so as to have an elevation difference Ah of approximately 5 mm to 15 mm. Further, the guide length (the dimension of the portion along the transport direction of the recording medium 9A) of the guiding portion 62*a* of the first guide part 62 is set so as to secure a length of at least approximately 5 mm to 15 mm. Further, the guiding portion 62*a* of the first guide part 62 is disposed so as to be inclined to the side where the second transfer device 35 is disposed, with respect to an exit-side normal TL to the nip part TN at the second transfer position. The oblique side 63*b* located on the upstream side in the transport direction of the second guide part 63 forms an angle (climbing angle/elevation angle) θ5 that is set as, for example, 0°<θ5≤60°. An end portion (guide entrance) 60*a* of the contact guide member 60 where guiding of the recording medium 9 begins is located at a separation distance K2 of approximately 10 mm to 30 mm from the exit-side end portion of the nip part TN at the second transfer position.

Further, as the auxiliary guide member 70, the exemplary embodiment adopts a member (made up of the first and second guide plates 81 and 82) having the extended guide portion 71, which is a guide portion obtained by linearly extending the guiding portion 62*a* of the first guide part 62 as it is, and the final guide portion 72, which is formed by an elevated guide portion that is elevated at a predetermined angle on the terminal end side of the extended guide portion 71 with respect to the imaginary extended line EL that is an extension of the projected guide line of the guiding portion 62*a*. The final guide portion 72 aids in bringing the leading edge 9*a* of the first recording medium 9A, which is transported while being guided by the first guide part 62, into contact with the guiding portion 51 of the introduction guide member 50 at a required contact angle θ1 or θ2 or at a required first position P1 or P2. However, the final guide portion 72 may not necessarily finally guides the leading edge 9*a* of the first recording medium 9A into contact with the guiding portion 51 under the above-mentioned predetermined condition (angle or position).

<Transport of Recording Medium Between Transfer Part and Fixing Part>

In the image forming apparatus 1 including the introduction guide member 50, the contact guide member 60, and the auxiliary guide member 70; the recording medium 9A or 9B is transported as described below between the transfer part and the fixing part.

First, an image forming operation using the first recording medium 9A represented by an envelope or the like will be described.

Figure 7:
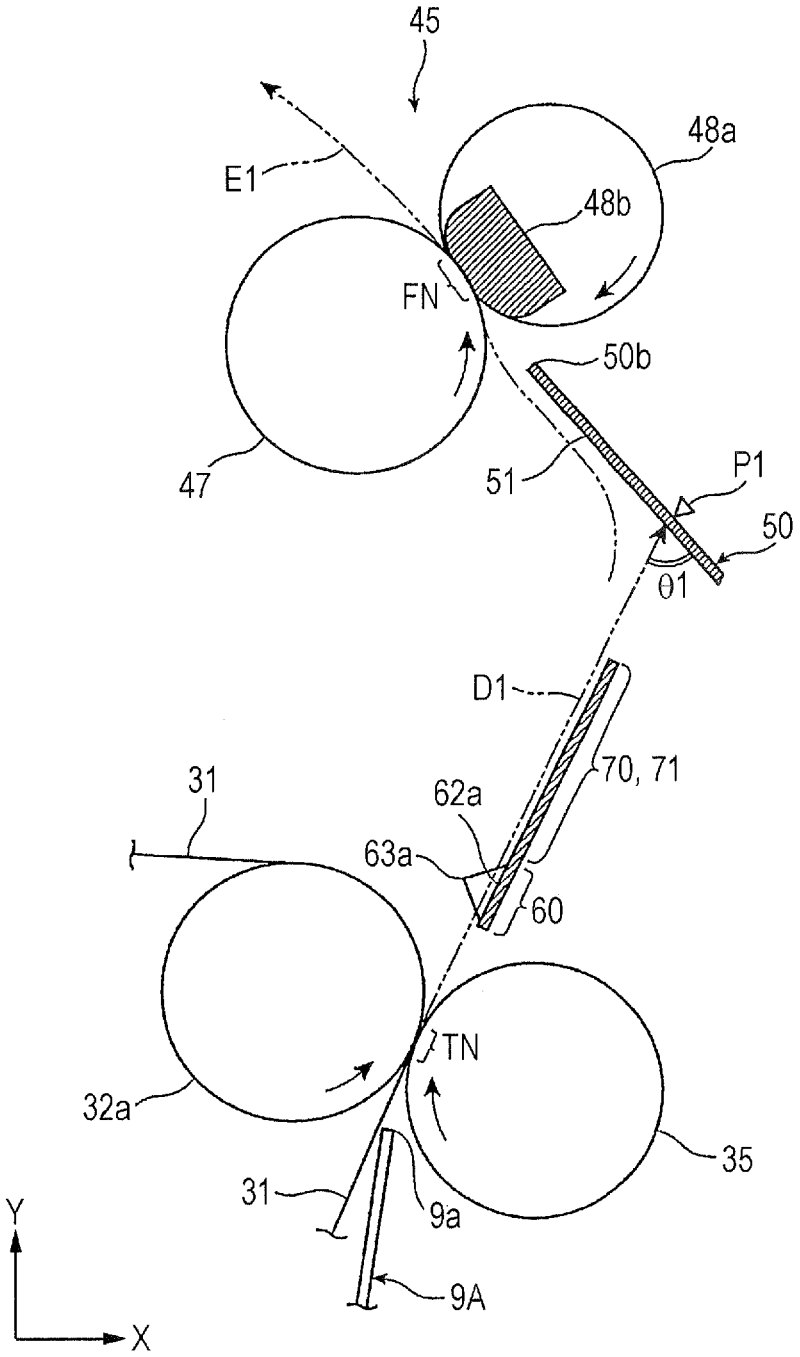
FIG. 7 illustrates an example of how a first recording medium is transported between a transfer part and a fixing part.

In this case, after a toner image is transferred to the first recording medium 9A by second transfer at the second transfer position of the intermediate transfer device 30, as illustrated in FIG. 7 and the like, the first recording medium 9A exits the nip part TN between the intermediate transfer belt 31 and the second transfer device 35 in a state in which its transport is controlled by the center registration system. Since the first recording medium 9A has a feed width less than the dimension of the short side of A4-size paper, the first recording medium 9A is then guided and transported to the first guide part 62, which is defined by the first passage width W1, of the contact guide member 60.

At this time, the first recording medium 9A travels with the leading edge 9*a* being guided by the guiding portion 62*a*, which is a linear guiding portion, of the first guide part 62. Consequently, the portion of the first recording medium 9A located rearward of the leading edge 9*a* is also transported substantially along the transport direction D1, which is the direction of transport controlled by the guiding portion 62*a*. The transport direction of the first recording medium 9A at this time is substantially determined by the guiding of the first recording medium 9A by the guiding portion 62*a*. At this time, the first recording medium 9A is sometimes subjected to auxiliary guiding action by the extended guide portion 71 and final guide portion 72 of the auxiliary guide member 70 located downstream in the transport direction of the guiding portion 62*a* of the first guide part 62.

Subsequently, the leading edge 9*a* of the first recording medium 9A, which is guided mostly by the guiding portion 62*a* of the first guide part 62 during its transport, reaches the introduction guide member 50 and comes into contact with the guiding portion 51. At this time, the leading edge 9*a* of the first recording medium 9A comes into contact with the guiding portion 51 of the introduction guide member 50 at the contact angle θ1 greater than that in the case of the second recording medium 9B described later, and also at the position P1 in the guiding portion 51 which is located farther from the nip part FN of the fixing device 45 than that in the case of the second recording medium 9B described later.

Subsequently, the leading edge 9*a* of the first recording medium 9A is guided and transported along the guiding portion 51, which is formed in a planar shape, of the introduction guide member 50. Then, upon passing through the terminal end portion 50*b* of the introduction guide member 50, as indicated by a two-dot chain line E1 in FIG. 7, the leading edge 9*a* of the first recording medium 9A approaches and then comes into contact with the heat rotator 47 of the fixing device 45 which rotates. After being transported in this state, the first recording medium 9A is introduced to the nip part FN of the fixing device 45.

Thereafter, in the nip part FN of the fixing device 45, the first recording medium 9A is nipped between the heat rotator 47 and the fixing belt 48*a* (the portion pressed by the pressing body 48*b*) that rotate. In this state, as the rotational force of the heat rotator 47 is applied to the first recording medium 9A to transport the first recording medium 9A, the first recording medium 9A continues to be transported, before finally passing through the nip part FN.

After the leading edge 9*a* of the first recording medium 9A is introduced to the nip part FN of the fixing device 45, the rearward portion of the first recording medium 9A excluding the leading edge 9*a* is transported so as to be guided by the first guide part 62 of the contact guide member 60 and the guiding portion 51 of the introduction guide member 50 as indicated by the two-dot chain line E1. However, in some cases, after the trailing edge of the first recording medium 9A passes through and exits the nip part TN of the second transfer part, the first recording medium 9A travels along the shortest path to the nip part FN of the fixing device 45, without being subjected to the guiding action of the first guide part 62 of the contact guide member 60 and the guiding portion 51 of the introduction guide member 50.

This means that the first recording medium 9A is introduced to the nip part FN of the fixing device 45 after the leading edge 9*a* of the first recording medium 9A is subjected to the guiding action of the guiding portion 51 of the introduction guide member 50 for a relatively long period of time. Consequently, the first recording medium 9A is transported in such a way that by the time its trailing edge exits the nip part TN of the second transfer part, its portion rearward of the leading edge 9*a* is guided by the guiding portion 51 of the introduction guide member 50 and then passes through the nip part FN of the fixing device 45. In the fixing device 45, as described above, the surface of the pressure rotator 48 (the fixing belt 48*a* pressed by the pressing body 48*b*) undergoes a greater amount of elastic deformation in the nip part FN than the surface of the heat rotator 47 (the surface of the roller). Consequently, in the nip part FN, the surface of the heat rotator 47 bites into the surface of the pressure rotator 48 (FIG. 2 and the like).

That is, as indicated by the two-dot chain line E1 in FIG. 7, at this time, the first recording medium 9A continues to be transported in such a state that, after passing through the terminal end portion 50*b* of the guiding portion 51 of the introduction guide member 50, the first recording medium 9A travels along a path that is slightly curved (bent to the right in the direction of travel), before entering the nip part FN of the fixing device 45. As the first recording medium 9A introduced to the nip part FN of the fixing device 45 passes through the nip part FN, the first recording medium 9A is transported so as to follow the curve of the peripheral surface of the heat rotator 47. As a result, the first recording medium 9A is transported in the following state. That is, its portion from the leading edge 9*a* to some point along its rearward portion is bent when passing through the terminal end portion 50*b* of the guiding portion 51 of the introduction guide member 50, and then bent in the opposite direction (to the left in the direction of travel) when passing through the nip part FN of the fixing device 45. The direction of travel mentioned above refers to the direction in which the recording medium 9 travels in the drawings (FIGS. 7, 8, and the like) illustrating an exemplary configuration according to Exemplary Embodiment 1 (the same will apply to the direction of travel hereinafter).

Consequently, if the first recording medium 9A is a double-sheet recording medium such as an envelope, wrinkling of its trailing edge portion in the transport direction is minimized as follows.

That is, when the first recording medium 9A such as an envelope is transported in a curved state when passing through the nip part FN of the fixing device 45 via the introduction guide member 50. Consequently, the two sheet portions of the double-sheet structure are subject to a difference in transport speed due to their difference in curvature (curvature difference), causing slight transport misalignment. That is, at this time, the first recording medium 9A travels in the following manner. That is, before being introduced to the nip part nip part FN via the introduction guide member 50, the first recording medium 9A is bent slightly to the right in the direction of travel, and when passing through the nip part FN, the first recording medium 9A is carried by the cylindrical peripheral surface of the heat rotator 47 and undergoes large bending to the left in the direction of travel.

However, in the image forming apparatus 1, the first recording medium 9A is reliably subjected to the guiding action of the guiding portion 51 of the introduction guide member 50 before being introduced to the nip part FN via the introduction guide member 50. Consequently, at some point during its transport, the first recording medium 9A is introduced to the nip part FN after undergoing large bending in a direction (leftward in the direction of travel) that is different from the direction (rightward in the direction of travel) in which the first recording medium 9A is bent before being introduced to the nip part FN. During the series of transport operations at this time, the first recording medium 9A is transported while being bent in, for example, an S-shape.

In particular, the first guide part 62 of the contact guide member 60 is configured so that the first contact angle θ1, at which the leading edge 9*a* of the first recording medium 9A having a double-sheet structure comes into contact with the guiding portion 51 of the introduction guide member 50, is greater than the second contact angle θ2 due to the second guide part 63. In other words, the first guide part 62 is configured so that the first position P1, at which the leading edge 9*a* of the first recording medium 9A comes into contact with the guiding portion 51 of the introduction guide member 50, is located farther away from the nip part FN of the fixing device 45 than the second position P2 due to the second guide part 63. Consequently, the first recording medium 9A having a double-sheet structure (such as an envelope) is strongly pressed against the guiding portion 51 of the introduction guide member 50, and then transported along the guiding portion 51. As a result, at this time, before the first recording medium 9A having a double-sheet structure is introduced to the nip part FN of the fixing device 45, the first recording medium 9A tends to be bent in a direction (leftward in the direction of travel) opposite to the direction (rightward in the direction of travel) in which the first recording medium 9A is bent in the nip part FN.

In this way, at this time, the portion of the first recording medium 9A from the leading edge 9*a* to some point along its rearward portion is subjected to two different bending states during its transport. This cancels out the difference in transport speed caused by the difference in curvature between the two sheet portions of the double-sheet structure, thus reducing transport misalignment.

Next, an image forming operation using the second recording medium 9B represented by heavy paper or the like will be described.

Figure 8:
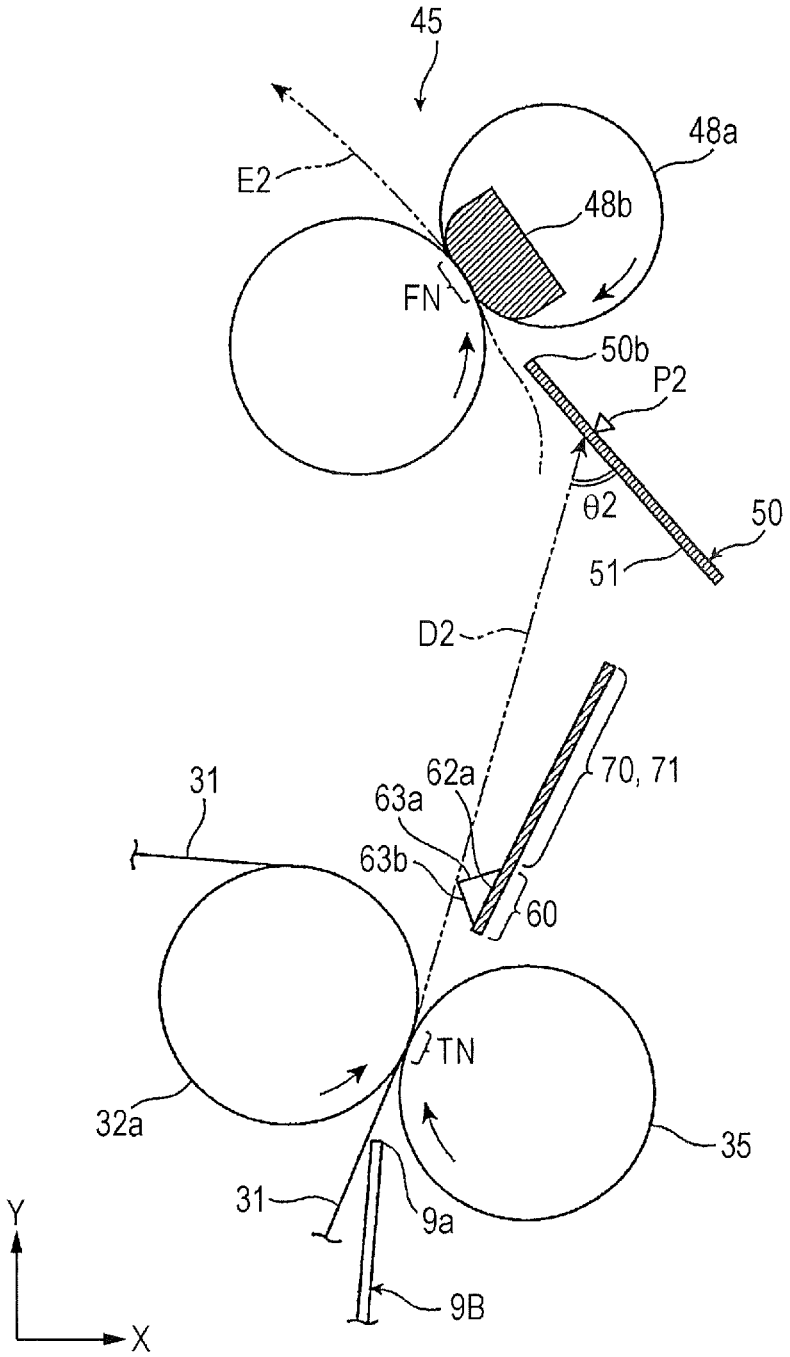
FIG. 8 illustrates an example of how a second recording medium is transported between a transfer part and a fixing part.

In this case, after a toner image is transferred to the second recording medium 9B by second transfer at the second transfer position of the intermediate transfer device 30, as illustrated in FIG. 8 and the like, the second recording medium 9B is discharged from the nip part TN between the intermediate transfer belt 31 and the second transfer device 35 in a state in which its transport is controlled by the center registration system. Since the second recording medium 9B has a feed width greater than or equal to the dimension of the short side of A4-size paper, at this time, the second recording medium 9B is guided and transported not to the first guide part 62 defined by the second passage width W1, but to the second guide part 63 defined by the second passage width W2 (>W1) of the contact guide member 60. That is, because of its relatively large feed width, the second recording medium 9B is not transported to the first guide part 62 having the first passage width W1 at this time.

At this time, the leading edge 9*a* of the second recording medium 9B is guided to the oblique side 63*b* located on the upstream side in the transport direction of the second guide part 63, and travels so as to pass through the guiding portion 63*a* at the apex. Consequently, the portion of the second recording medium 9B located rearward of the leading edge 9*a* is also transported substantially along the transport direction D2, which is the direction of transport controlled by the guiding portion 63*a*. The transport direction of the second recording medium 9B at this time is substantially determined by the guiding of the second recording medium 9B by the guiding portion 63*a*. Incidentally, even in the event of an abnormal transport state, such as when the second recording medium 9B is transported on a different path as its transport direction deviates from the transport direction D2 toward the transport direction D1, this condition is remedied as the second recording medium 9B is guided by the extended guide portion 71 and final guide portion 72 of the auxiliary guide member 70 located downstream in the transport direction of the guiding portion 63*a* of the second guide part 63, thus preventing paper jams or the like.

Subsequently, the leading edge 9*a* of the second recording medium 9B, which is guided by the guiding portion 63*a* of the second guide part 63 during its transport, reaches the introduction guide member 50 and comes into contact with the guiding portion 51. At this time, the leading edge 9*a* of the second recording medium 9B comes into contact with the guiding portion 51 of the introduction guide member 50 at the contact angle θ2 that is less than that in the case of the first recording medium 9A described above, and also at the position P2 in the guiding portion 51 which is located closer to the nip part FN of the fixing device 45 than that in the case of the first recording medium 9A described above.

Subsequently, the leading edge 9*a* of the second recording medium 9B is guided and transported along the guiding portion 51, which is formed in a planar shape, of the introduction guide member 50, and then passes through the terminal end portion 50*b* of the introduction guide member 50. Subsequently, as indicated by a two-dot chain line E2 in FIG. 8, the leading edge 9*a* of the second recording medium 9B approaches and then comes into contact with the heat rotator 47 of the fixing device 45 which rotates. After being transported in that state, the second recording medium 9B is introduced to the nip part FN of the fixing device 45.

Thereafter, in the nip part FN of the fixing device 45, the second recording medium 9B is nipped between the heat rotator 47 and the fixing belt 48*a* that rotate. In this state, as the rotational force of the heat rotator 47 is applied to the second recording medium 9B to transport the second recording medium 9B, the second recording medium 9B continues to be transported, before finally passing through the nip part FN.

After the leading edge 9*a* of the second recording medium 9B is introduced to the nip part FN of the fixing device 45, the rearward portion of the second recording medium 9B excluding the leading edge 9*a* passes through the second guide part 63 of the contact guide member 60, and is transported so as to be guided by the guiding portion 51 of the introduction guide member 50 as indicated by the two-dot chain line E2. At this time, once the trailing edge of the second recording medium 9B passes through and exits the nip part TN of the second transfer part, the second recording medium 9B tends to travel along the shortest path to the nip part FN of the fixing device 45, without being subjected to the guiding action of the second guide part 63 of the contact guide member 60 and the guiding portion 51 of the introduction guide member 50.

This means that the second recording medium 9B is introduced to the nip part FN of the fixing device 45, after the leading edge 9*a* of the second recording medium 9B comes into contact with the introduction guide member 50 at a relatively small angle and is subjected to the guiding action of the guiding portion 51 over a relatively short distance in comparison to the first recording medium 9A. Consequently, the second recording medium 9B is transported in such a way that by the time its trailing edge exits the nip part TN of the second transfer part, its portion rearward of the leading edge 9*a* is also guided by the guiding portion 51 of the introduction guide member 50 for a short period of time or over a short distance and then passes through the nip part FN of the fixing device 45.

If the second recording medium 9B is a recording medium with a high stiffness characteristic such as heavy paper, in particular, the above configuration minimizes image disturbances represented by a toner image transfer failure due to the influence of vibration occurring when the second recording medium 9B comes into contact with the introduction guide member 50. Heavy paper is a type of paper with a basis weight of greater than or equal to, for example, 106 gsm.

That is, in the case of the second recording medium 9B with a high stiffness such as heavy paper, the following image disturbances may occur in some cases if, for example, the leading edge 9*a* of the second recording medium 9B comes into contact with the guiding portion 51 of the introduction guide member 50 at a relatively large contact angle θ1 as in the case of the first recording medium 9A. Specifically, such image disturbances include failures such as a first-transfer failure and a second-transfer failure. A second-transfer failure occurs when the impact (vibration) caused by the above contact is transmitted to the rearward portion of the second recording medium 9B, with the result that at the time of transfer of a toner image in the second transfer part, the toner image is not properly transferred to the second recording medium 9B that is vibrating as a result. A first-transfer failure occurs when the vibration of the second recording medium 9B is also transmitted to the intermediate transfer belt 31, with the result that at the time of transfer of a toner image in the first transfer part, the toner image is not properly transferred to the intermediate transfer belt 31 that is vibrating as a result.

However, in the image forming apparatus 1, the second recording medium 9B comes into contact with the guiding portion 51 of the introduction guide member 50 at a relatively small contact angle θ2 in comparison to that (contact angle θ1) in the case of the first recording medium 9A. In other words, the second recording medium 9B comes into contact with the guiding portion 51 of the introduction guide member 50 at a position (second position P2) that is relatively close to the transfer part FN in comparison to that (first position P1) in the case of the first recording medium 9A. This configuration minimizes vibration of the second recording medium 9B at this time due to impact exerted when the leading edge 9*a* of the second recording medium 9B comes into contact with the guiding portion 51 of the introduction guide member 50. In this regard, even if vibration does occur at the leading edge 9*a* of the second recording medium 9B, transmission of the vibration to the rearward portion of the second recording medium 9B, and hence further to the intermediate transfer belt 31 is reduced.

Further, in the image forming apparatus 1 according to Exemplary Embodiment 1, the contact guide member 60 may be also understood as being configured as follows.

Figure 9:
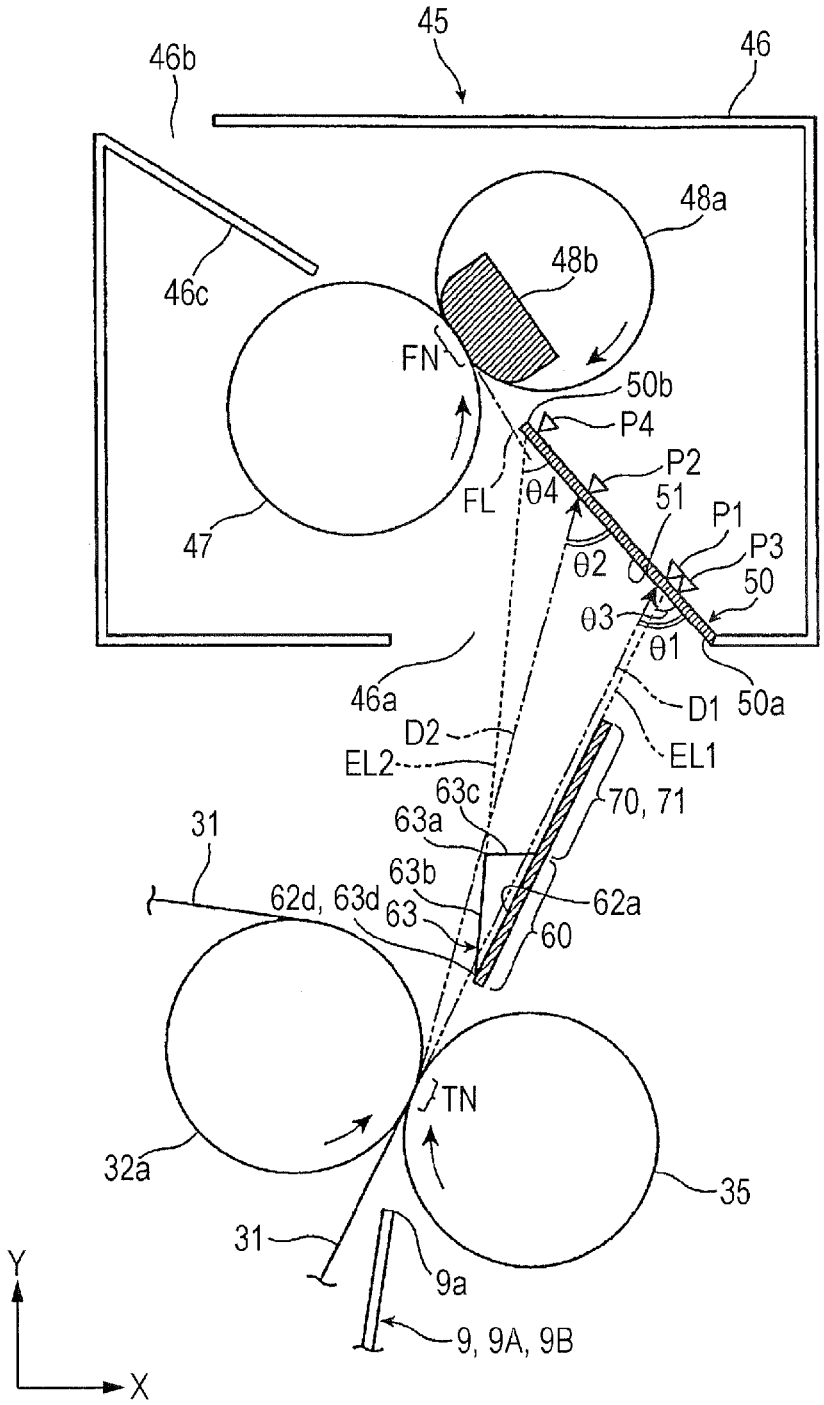
FIG. 9 is a schematic view, partly in section, of a configuration of an auxiliary guide member as perceived from a different perspective.

That is, as illustrated in FIG. 9, the contact guide member 60 of the image forming apparatus 1 is configured so that a third angle θ3 is greater than a fourth angle θ4 (θ3>θ4). The third angle θ3 is an angle formed between an extended straight line EL1, which is extended along the guiding portion 62*a* that guides the back side of the first recording medium 9A at an entrance side 62*d* of the first guide part 62, and the guiding portion 51 of the introduction guide member 50. The fourth angle θ4 is an angle formed between an extended straight line EL2, which is extended along the guiding portion 63*b* that guides the back side of the second recording medium 9B at an entrance side 63*d* of the second guide part 63, and the guiding portion 51 of the introduction guide member 50.

The above configuration can be also stated in other words as follows.

That is, as illustrated in FIG. 9, the contact guide member 60 of the image forming apparatus 1 is configured so that a third position P3 is located farther from the nip part FN of the fixing device 45 than a fourth position P4. The third position P3 is the position at which the extended straight line EL1, which is extended along the guiding portion 62*a* that guides the back side of the first recording medium 9A at the entrance side 62*d* of the first guide part 62, interests the guiding portion 51 of the introduction guide member 50. The fourth position P4 is the position at which the extended straight line EL2, which is extended along the guiding portion 63*b* that guides the back side of the second recording medium 9B at the entrance side 63*d* of the second guide part 63, intersects the guiding portion 51 of the introduction guide member 50.

The guiding portion 62*a* that guides the back side of the first recording medium 9A for the first time at the entrance side 62*d* of the first guide part 62 is, for example, a linear guide part. The guiding portion 63*b* that guides the back side of the second recording medium 9B at the entrance side 63*d* of the second guide part 63 is, for example, an inclined part that slopes upward in the direction of travel (guide) in which the second recording medium 9B is guided. An angle θ5, which is formed by the guiding portion 63*b* with the guiding portion 62*a* of the first guide part 62 at the entrance side 63*d* of the second guide part 63, is set to such an angle that ensures that the extended straight line EL2, which is extended along the guiding portion 63*b*, intersects the guiding portion 51 of the introduction guide member 50 without fail.

Incidentally, at this time, the third contact angle θ3 and the fourth contact angle θ4 have the following relationships with the first contact angle θ1 and the second contact angle θ2 described above, respectively (FIG. 9).

The third contact angle θ3 is substantially equal to the first contact angle θ1 (θ3≈θ1). The fourth contact angle θ4 is either smaller than, or equal to, the second contact angle θ2 (θ4≤θ2).

Further, at this time, the third position P3 and the fourth position P4 have the following relationships with the first position P1 and the second position P2 described above, respectively.

The third position P3 is located at substantially the same distance from the nip part FN as the first position P1 (P3≈P1). The fourth position P4 is either located closer to the nip part FN than the second position P2, or located at the same distance from the nip part FN as the second position P2.

In the image forming apparatus 1 including the contact guide member 60 understood to be configured as described above (also accompanied with the introduction guide member 50 and the auxiliary guide member 70), the first or second recording medium 9A or 9B is transported in substantially the same manner as mentioned above (FIGS. 7 and 8) between the transfer part and the fixing part.

Other Exemplary Embodiments

In Exemplary Embodiment 1 above, the introduction guide member 50 is implemented as a member (flat plate or the like) with the guiding portion 51 that is formed by a planar surface. Alternatively, the introduction guide member 50 may be implemented as, for example, a member provided with the guiding portion 51 formed by linear projections (ribs) arranged in a parallel fashion on one side of a plate-like base material along the transport direction of the recording medium 9. The introduction guide member 50 in this case can be fabricated by using, for example, a synthetic resin material.

In Exemplary Embodiment 1 above, the second guide part 63 of the contact guide member 60 has the shape of a triangle with the two oblique sides 63*b* and 63*c* (FIG. 2 and the like). Alternatively, the second guide part 63 may have, for example, a plate-like shape with a planar surface corresponding to the oblique side 63*b* located on the upstream side in the transport direction.

In Exemplary Embodiment 1 above, the auxiliary guide member 70 is provided between the introduction guide member 50 and the contact guide member 60. However, the auxiliary guide member 70 may not be provided. Alternatively, the auxiliary guide member 70 to be provided may be configured as the auxiliary guide member 70 (the auxiliary guide member configured as illustrated in FIG. 2 and the like) made up of only the extended guide portion 71 excluding the final guide portion 72.

Figure 10:
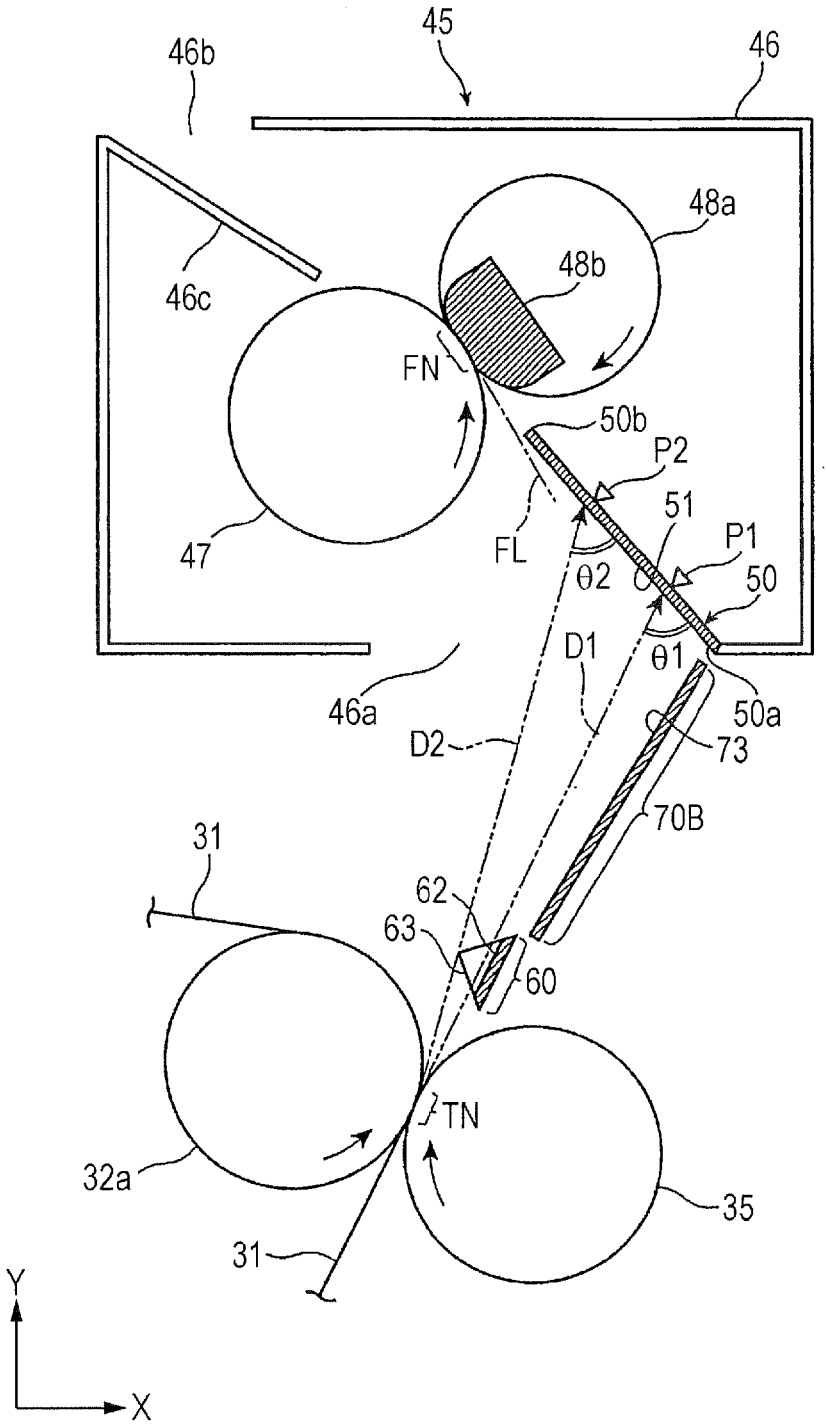
FIG. 10 is an enlarged schematic view, partly in section, of another configuration example of an auxiliary guide member.

For example, as illustrated in FIG. 10, the auxiliary guide member 70 may be implemented as an auxiliary guide member 70B that is placed independently from the contact guide member 60. In this case, for example, the auxiliary guide member 70B may be implemented as a member having a guiding portion 73 configured as described below. That is, the guiding portion 73 is a linear portion that is not contiguous with the guiding portion 62*a*, which has a linear shape, of the first guide part 62 of the contact guide member 60, and is located away from the transport direction D1 of the first recording medium 9A.

Furthermore, Exemplary Embodiment 1 is directed to arrangement of components such as the introduction guide member 50 and the contact guide member 60 between the nip part FN of the fixing device 45 and the nip part TN of the second transfer part in the case where the nip part FN is located at a distance vertically above the nip part TN. However, components such as the contact guide member 60 may be arranged between the nip part FN of the fixing device 45 and the nip part TN of the second transfer part also in the case where the nip part FN is located at a distance from the nip part TN in substantially the horizontal direction. In this case, in the horizontal direction, the nip part FN of the fixing device 45 is desirably located at a position slightly shifted vertically upward with respect to the nip part TN of the second transfer part.

In Exemplary Embodiment 1 above, the pressure rotator 48 of the fixing device 45 is configured by components such as the fixing belt 48*a* and the pressing body 48*b*. Alternatively, the pressure rotator 48 may be implemented in the form of a roller (pressure roller).

In further another exemplary embodiment of the invention, the image forming apparatus may adopt a so-called side registration system for the recording medium 9. The side registration system is a transport control system which controls transport of the recording medium 9 so that one end side along the feed width of the recording medium 9 passes through one end portion along the feed width of the transport path of the recording medium 9. In this case, the first guide part 62 of the contact guide member 60 may be provided at a position shifted toward the end portion that is subject to control by the side registration system. Exemplary embodiments of the invention are not limited to the image forming apparatus 1 configured as described above with reference to Exemplary Embodiment 1. Exemplary embodiments of the invention are also applicable to, for example, an image forming apparatus of a type which directly transfers a toner image to the recording medium 9 from a toner image carrier such as a photoconductor.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer device that has a toner image carrier and a transfer body that rotate, and a transfer part where the toner image carrier and the transfer body contact each other, the transfer device allowing a recording medium to pass through the transfer part to transfer a toner image to the recording medium;

a fixing device that has a heat body and a pressure body that rotate, and a fixing part where the heat body and the pressure body contact each other, the fixing device allowing the recording medium with the toner image transferred by the transfer device to pass through the fixing part to fix the toner image to the recording medium;

an introduction guide member that has a guiding portion, the introduction guiding member being disposed at an entrance side of the fixing device, the introduction guide member guiding a leading edge of the recording medium so that the leading edge of the recording medium approaches the heat body before being introduced to the fixing part; and a contact guide member that is disposed between the transfer device and the introduction guide member, the contact guide member guiding the leading edge of the recording medium into contact with the guiding portion of the introduction guide member, wherein the contact guide member has a first guide part that guides a leading edge of a first recording medium into contact with the introduction guide member at a first contact angle, the first recording medium including a recording medium of a double-sheet structure, and a second guide part that guides a leading edge of a second recording medium into contact with the introduction guide member at a second contact angle, the second recording medium having a feed width greater than a passage width of the first guide part, wherein the first contact angle is an angle formed by a back side of the leading edge of the first recording medium with the guiding portion of the introduction guide member, and the second contact angle is an angle formed by a back side of the leading edge of the second recording medium with the guiding portion of the introduction guide member, and wherein the first guide part and the second guide part are configured so that the first contact angle is greater than the second contact angle.

2. An image forming apparatus comprising:

a transfer device that has a toner image carrier and a transfer body that rotate, and a transfer part where the toner image carrier and the transfer body contact each other, the transfer device allowing a recording medium to pass through the transfer part to transfer a toner image to the recording medium;

a fixing device that has a heat body and a pressure body that rotate, and a fixing part where the heat body and the pressure body contact each other, the fixing device allowing the recording medium with the toner image transferred by the transfer device to pass through the fixing part to fix the toner image to the recording medium;

an introduction guide member that has a guiding portion, the introduction guiding member being disposed at an entrance side of the fixing device, the introduction guide member guiding a leading edge of the recording medium so that the leading edge of the recording medium approaches the heat body before being introduced to the fixing part; and a contact guide member that is disposed between the transfer device and the introduction guide member, the contact guide member guiding the leading edge of the recording medium into contact with the guiding portion of the introduction guide member, wherein the contact guide member has a first guide part that guides a leading edge of a first recording medium into contact with the introduction guide member at a first position, the first recording medium including a recording medium of a double-sheet structure, and a second guide part that guides a leading edge of a second recording medium into contact with the introduction guide member at a second position, the second recording medium having a feed width greater than a passage width of the first guide part, and wherein the first guide part and the second guide part are configured so that the first position is located farther than the second position from the fixing part.

3. An image forming apparatus comprising:

a transfer device that has a toner image carrier and a transfer body that rotate, and a transfer part where the toner image carrier and the transfer body contact each other, the transfer device allowing a recording medium to pass through the transfer part to transfer a toner image to the recording medium;

a fixing device that has a heat body and a pressure body that rotate, and a fixing part where the heat body and the pressure body contact each other, the fixing device allowing the recording medium with the toner image transferred by the transfer device to pass through the fixing part to fix the toner image to the recording medium;

an introduction guide member that has a guiding portion, the introduction guiding member being disposed at an entrance side of the fixing device, the introduction guide member guiding a leading edge of the recording medium so that the leading edge of the recording medium approaches the heat body before being introduced to the fixing part; and a contact guide member that is disposed between the transfer device and the introduction guide member, the contact guide member guiding the leading edge of the recording medium into contact with the guiding portion of the introduction guide member, wherein the contact guide member has a first guide part that guides a first recording medium, the first recording medium including a recording medium of a double-sheet structure, and a second guide part that guides a second recording medium, the second recording medium having a feed width greater than a passage width of the first guide part, wherein the first guide part has a guiding portion that guides a back side of the first recording medium at an entrance side of the first guide part, and the second guide part has a guiding portion that guides a back side of the second recording medium at an entrance side of the second guide part, and wherein a third angle, which is formed between a straight line extended along the guiding portion of the first guide part and the guiding portion of the introduction guide member, is greater than a fourth angle, which is formed between a straight line extended along the guiding portion of the second guide part and the guiding portion of the introduction guide member.

4. An image forming apparatus comprising:

a transfer device that has a toner image carrier and a transfer body that rotate, and a transfer part where the toner image carrier and the transfer body contact each other, the transfer device allowing a recording medium to pass through the transfer part to transfer a toner image to the recording medium;

a fixing device that has a heat body and a pressure body that rotate, and a fixing part where the heat body and the pressure body contact each other, the fixing device allowing the recording medium with the toner image transferred by the transfer device to pass through the fixing part to fix the toner image to the recording medium;

an introduction guide member that has a guiding portion, the introduction guiding member being disposed at an entrance side of the fixing device, the introduction guide member guiding a leading edge of the recording medium so that the leading edge of the recording medium approaches the heat body before being introduced to the fixing part; and a contact guide member that is disposed between the transfer device and the introduction guide member, the contact guide member guiding the leading edge of the recording medium into contact with the guiding portion of the introduction guide member, wherein the contact guide member has a first guide part that guides a first recording medium, the first recording medium including a recording medium of a double-sheet structure, and a second guide part that guides a second recording medium, the second recording medium having a feed width greater than a passage width of the first guide part, wherein the first guide part has a guiding portion that guides a back side of the first recording medium at an entrance side of the first guide part, and the second guide part has a guiding portion that guides a back side of the second recording medium at an entrance side of the second guide part, and wherein a third position, at which a straight line extended along the guiding portion of the first guide part intersects the guiding portion of the introduction guide member, is located farther from the fixing part than a fourth position, at which a straight line extended along the guiding portion of the second guide part intersects the guiding portion of the introduction guide member.

5. The image forming apparatus according to claim 1, wherein:

the first guide part of the contact guide member has a guiding portion through which the first recording medium is passed to determine a transport direction, and the second guide part of the contact guide member has a guiding portion through which the second recording medium is passed to determine a transport direction; and the guiding portion of the first guide part is located lower than the guiding portion of the second guide part.

6. The image forming apparatus according to claim 1, wherein the guiding portion of the introduction guide member extends continuously in an inclined manner as a whole so as to gradually approach an entrance-side normal to the fixing part with increasing proximity to the fixing part of the fixing device.

7. The image forming apparatus according to claim 1, wherein in the fixing part of the fixing device, a surface of the pressure body undergoes a greater amount of deformation than a surface of the heat body.

* * * * *